US007640922B2

(12) United States Patent
Siebelink

(10) Patent No.: US 7,640,922 B2
(45) Date of Patent: Jan. 5, 2010

(54) FOAM DART GUN

(76) Inventor: Thomas Siebelink, 3605 Wentworth SW., Wyoming, MI (US) 49519

( * ) Notice: Subject to any disclaimer, the term of this patent is extended or adjusted under 35 U.S.C. 154(b) by 229 days.

(21) Appl. No.: 11/683,499

(22) Filed: Mar. 8, 2007

(65) Prior Publication Data

US 2007/0209646 A1 Sep. 13, 2007

Related U.S. Application Data

(60) Provisional application No. 60/780,303, filed on Mar. 8, 2006.

(51) Int. Cl.
*F41B 7/00* (2006.01)

(52) U.S. Cl. ..... 124/17

(58) Field of Classification Search ..... 124/17, 124/20.1, 20.3, 48
See application file for complete search history.

(56) References Cited

U.S. PATENT DOCUMENTS 2,825,322 A 3/1958 Burley, Jr. et al.
3,014,308 A 12/1961 Parris
3,119,385 A 1/1964 Ashley
3,757,760 A * 9/1973 Darnell ..... 124/19
4,050,438 A 9/1977 Pfotenhauer
4,800,864 A 1/1989 Small
4,802,677 A 2/1989 Homan
5,282,453 A 2/1994 Chia
5,460,150 A 10/1995 Joppe
5,595,166 A 1/1997 Schmidt, III et al.
6,079,398 A 6/2000 Grimm
6,247,990 B1 6/2001 Moorhouse
6,500,042 B1 12/2002 LaPointe

* cited by examiner

*Primary Examiner*—John Ricci
(74) *Attorney, Agent, or Firm*—Price, Heneveld, Cooper, DeWitt & Litton, LLP

(57) ABSTRACT

The present invention includes a foam dart gun having a cylindrically shaped, typically hollow barrel with a plurality of hooks disposed at a first end of the barrel. Inner and outer elastic bands engaged with one another to form an elastomeric band assembly, which is typically engaged to the barrel at least proximate the end of the barrel opposite a trigger.

4 Claims, 13 Drawing Sheets

12
30
32
34
35a
35a
36
38
39

30
32
34
35a
35a
36
38
39
40

31
33
31a
31b
31c

31d'
31'

31e
31''

31'
31d
33'
31a'
31b'

31''
31e
33''
31a''
31b''

FOAM DART GUN

CROSS REFERENCE TO RELATED APPLICATION

This application claims benefit under 35 U.S.C. § 119(e) of provisional application Ser. No. 60/780,303, filed Mar. 8, 2006, entitled FOAM DART GUN, the entire contents of which are incorporated herein in their entirety.

BACKGROUND OF THE PRESENT INVENTION

The present invention generally relates to a foam dart gun and the like and in particular to a foam dart gun capable of rapidly firing a plurality of foam darts utilizing energy stored in a series of elastomeric members.

Toy projectile launchers, including toy projectile guns, have utilized numerous arrangements to apply a launching force to a projectile. Launchers that utilize elastomeric, or rubber, bands oftentimes suffer from the band breaking from fatigue or overuse. Also, when a single elastomeric band has been used to propel a projectile there is no retracting or retaining force applied to the elastomeric band. Once released, the elastomeric band is difficult to control, and often alters the trajectory of the toy projectile. Specifically, the elastomeric band may contact the body or fins of the rocket once the elastomeric band is no longer in tension, and interfere with the speed and accuracy of the rocket. Also, a single elastomeric band stores less energy than several combined bands. Velocity, distance, and trajectory suffer as a result. Additionally, constant loading and unloading of a single elastomeric band can permanently stretch the band, which lessens the potential energy capable of being stored in the elastomeric band. As a result, less kinetic energy can be transferred to the projectile when launched. In addition, it is often the case that a user of a foam dart gun is allowed a single shot before having to reload, or cock, the elastomeric band so that a second projectile may be launched. Further, the end of the elastomeric band connected to the projectile is left dangling from the gun. Not only are dangling bands cumbersome to re-load and not in position to receive a dart after being fired, but they also can catch foreign objects and break and pose a danger to the user. Accordingly, a foam dart gun that withstands fatigue and improves control of the elastomeric band (s) after a projectile has been launched would prove useful. Furthermore, there is a significant need for a foam dart gun that allows a user to accurately and rapidly fire successive toy projectiles, including foam darts, at an increased velocity to achieve a greater distance.

SUMMARY OF THE INVENTION

One aspect of the present invention is a foam dart launcher having a cylinder with a plurality of hooks disposed at a first end of the cylinder. Inner and outer elastic bands are at a second end of the cylinder and the inner elastic band ends engage a middle portion of the cylinder and the outer band ends engage a distal end of the cylinder. In addition, the outer elastic bands typically engage an inner elastic band to form an elastomeric band assembly. The foam dart gun also has a trigger.

The foam dart gun is capable of rapidly firing foam darts and, utilizing the elastomeric band assembly, immediately store the elastomeric members in a controlled manner after the foam darts have been launched. The invention further includes a trigger that actuates deployment of the foam darts each time the trigger is depressed and each time the trigger is released. The manner in which the elastomeric members are secured to the barrel facilitates lowering of elastomeric band replacement costs. Further, multiple foam dart guns are not necessary for a single user because multiple foam darts can be loaded and fired from the same single foam dart gun before reloading is necessary.

These and other features, advantages, and objects of the present invention will be further understood and appreciated by those skilled in the art upon studying the following specification, claims, and appended drawings.

DETAILED DESCRIPTION OF PREFERRED EMBODIMENTS

Figure 1:
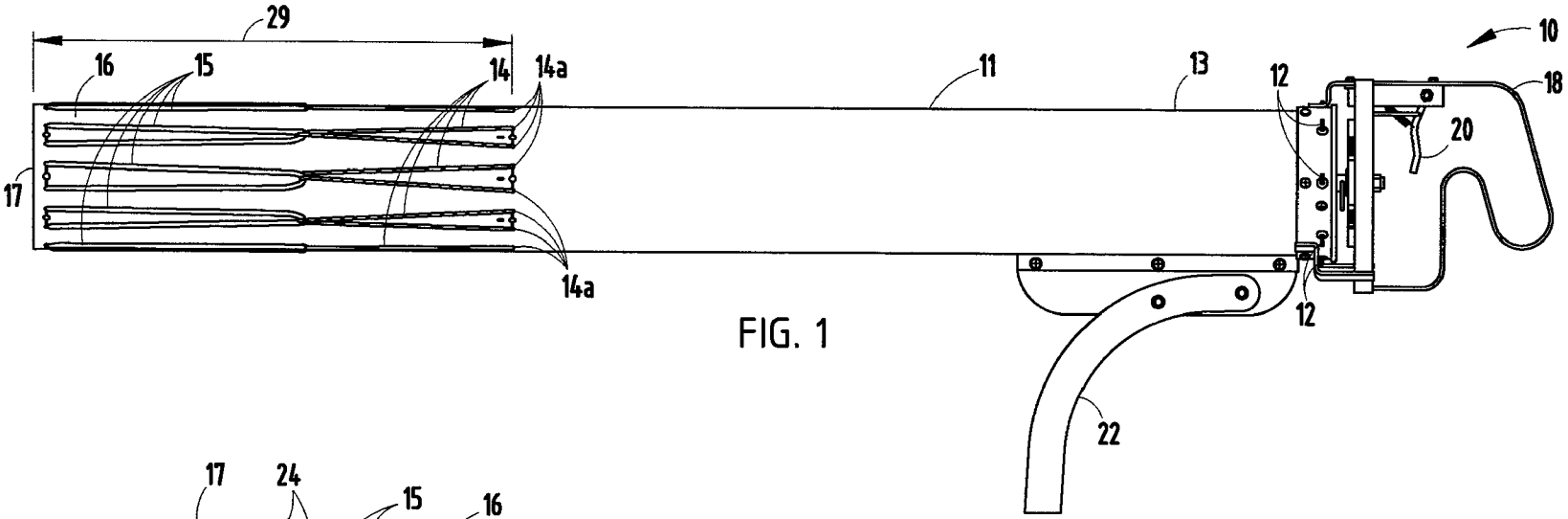
FIG. 1 is a side elevational view of an embodiment of the foam dart launching gun of the present invention.

For purposes of description herein the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 shown in FIG. 1 generally designates a gun 10 having an elongated, typically cylindrical barrel 11 with a plurality of rocket retention appendages, typically hooks 12, which are disposed at a first end 13 of the barrel 11, which is proximate trigger 20. The plurality of hooks 12 are typically spaced at equal distances on a rim secured by fasteners around the outer circumference of the barrel 11. Inner elastic bands 14 and outer elastic bands 15 are typically disposed at a second end 16 of the barrel 11. The number of hooks 12 is usually equal to the number of inner elastic bands 14 and the number of outer elastic bands 15. Also, each hook 12 is typically aligned with a corresponding pair of inner and outer elastic bands 14, 15. The inner elastic band ends 14*a* engage the barrel 11 between the first and second ends 13, 16. Typically, the inner elastic band ends 14*a* engage the barrel 11 approximately ⅓ of the length of the barrel 11 from a distal end 17 of the barrel 11. The outer elastic band ends 15*a* engage the barrel 11 near the distal end 17 of the barrel 11. The outer elastic bands 15 engage the inner elastic bands 14, typically at the mid point of each band.

The first end 13 of the barrel 11 has an upper handle 18 adjacent to trigger 20 and positioned to allow actuation of the trigger 20. A lower handle 22 is disposed on a lower portion of the barrel 11 at least proximate the first end 13 of the barrel 11. The length of the barrel 11 will typically be at least two to three feet long. The barrel length is generally determined by the strength of the elastomeric bands. Typically, the barrel is approximately 300% of the length of the elastomeric band configuration shown on FIG. 1 as length 29. The barrel 11 is preferably adapted to be maneuvered by a user by firmly grasping the lower handle 22 and the upper handle 18. The lower handle 22 is also typically adapted for use by a person's hand or shoulder.

Figure 2A:
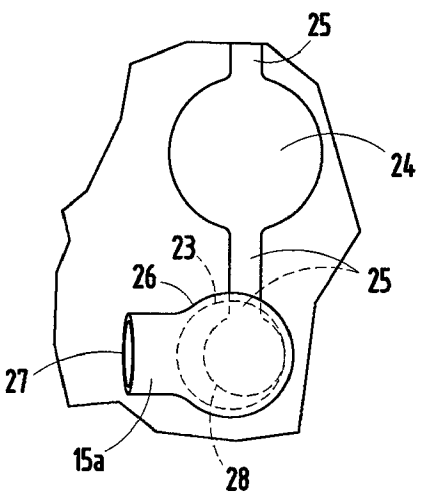
FIG. 2*a* is an enlarged elevational view of section IIA of FIG. 2.
Figure 2:
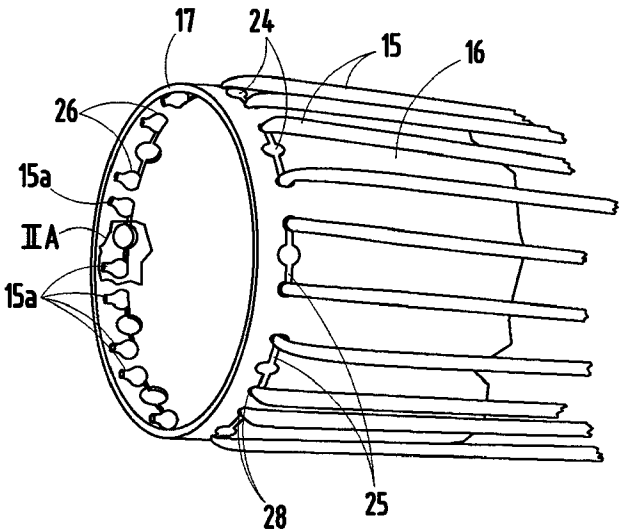
FIG. 2 is an enlarged perspective view of an end of the foam dart gun that utilizes the elastomeric band assemblies of FIG. 1.

FIG. 2 shows the outer elastic band ends 15*a* engaged to the distal end 17 of the barrel 11. As readily seen in FIG. 2, the distal end 17 of the barrel typically has a plurality of elastomeric member receiving apertures 24 preferably evenly spaced about the distal end 17 of the barrel 11. Typically, each of the elastomeric member receiving apertures 24 have two outwardly extending, opposing grooves 25 that interconnect the elastomeric member receiving apertures 24 with retaining apertures 28. The retaining apertures 28 are typically of a smaller diameter than the elastomeric member receiving apertures 24. The outer elastic band ends 15*a* have a bulbous end 26 created from the outer elastic band end 15*a* being stretched over a spherically-shaped member 23 (shown in hidden lines) disposed inside a cavity 27 in the outer elastic band 15*a*. The bulbous end 26 is inserted into the elastomeric member receiving apertures 24. Thereafter, the inner and outer elastic band ends 14*a*, 15*a* are pinched and slid through the outwardly extending grooves 25 until the bulbous end 26 is retained in the retaining apertures 28 on the interior surface of the barrel 11. When loaded, the tension on the outer elastic band forces the bulbous end 26 against the interior of the barrel 11. The bulbous end 26 prevents the outer elastic band 15 from withdrawing from the distal end 17 of the barrel 11 during use and allows for easy replacement of an individual elastomeric band or band assemblies.

Figures 3, 4, 5, 5A, 5B, 5C, 5D:
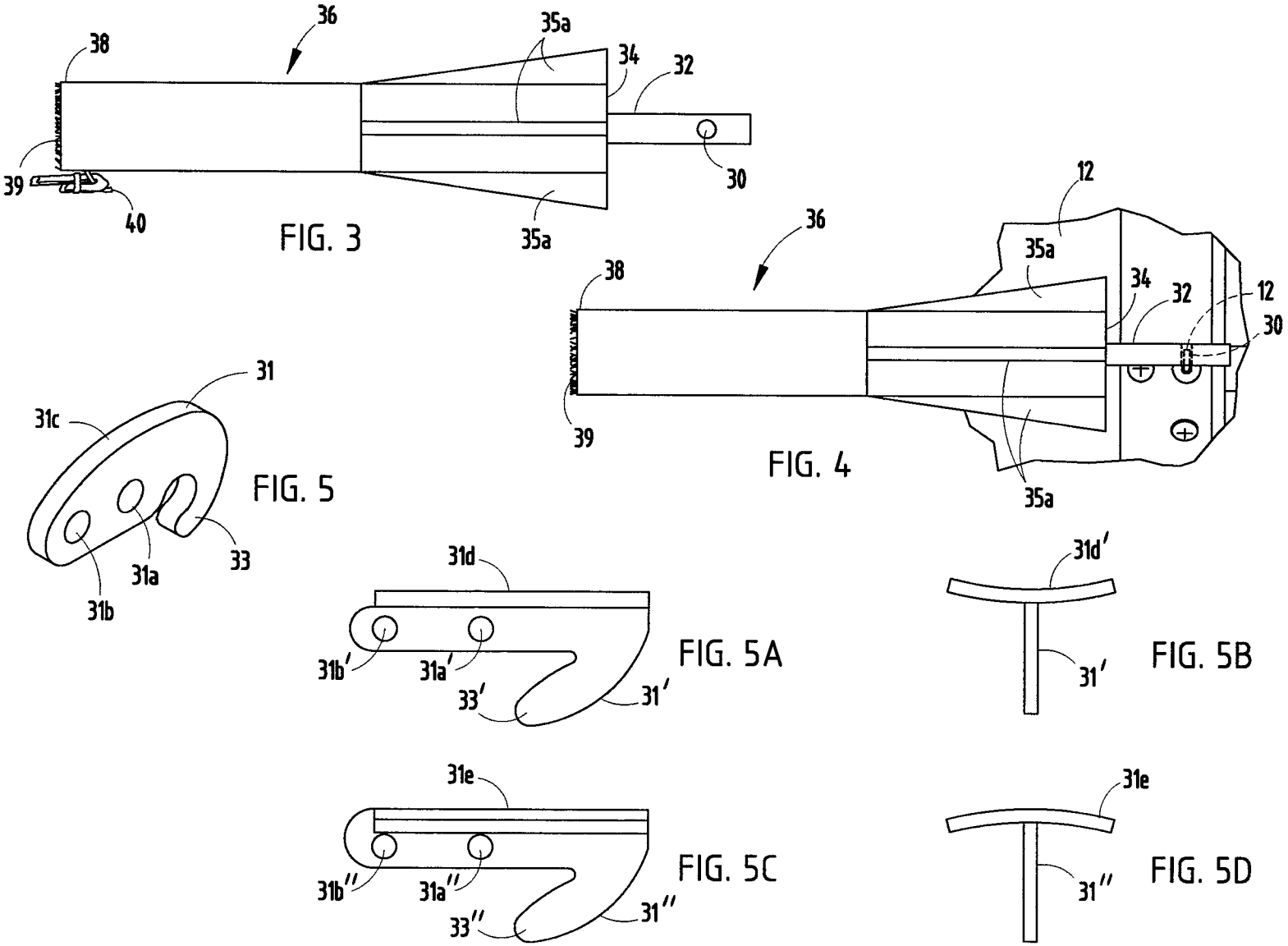
FIG. 3 is an enlarged partial side elevational view of one embodiment of a foam dart.
FIG. 4 is a top elevational view of the foam dart of FIG. 3 in a loaded position.
FIG. 5 is an enlarged perspective view of a catch that may be used in one embodiment of the present invention.
FIG. 5A in an enlarged side elevational view of another embodiment of a catch.
FIG. 5B is an enlarged back elevational view of the catch of FIG. 5A.
FIG. 5C is an enlarged side elevational view of yet another embodiment of a catch.
FIG. 5D is an enlarged back elevational view of the catch of FIG. 5C.

Referring to FIGS. 3 and 4, the retaining hooks 12 are adapted to be inserted into a retaining hook receiving aperture 30 in a rod 32 disposed at a rear end 34 of a dart 36. The dart 36 is typically constructed of foam material and includes several fins 35*a*. The rod 32 is typically substantially aligned with a longitudinal axis of the dart 36. A front end 38 of the dart 36 usually employs one component of a hook and loop fastening system 39 such as VELCRO® which, in a game-playing situation, would attach readily to an opponent's vest, utilizing a complementary component of the hook and loop fastening system 39. In this manner, one would readily know when the target is "hit" when playing various games. The front end 38 of the foam dart 36 may employ a catch 40 that releasably connects to the mid-point of each of inner and outer elastic bands 14 and 15, respectively. During use, numerous foam darts 36 may be used in connection with the gun 10. Each dart engages the gun 10 by engaging the catch 40 to the mid-points of both the inner and outer elastic bands 14 and 15. Simultaneously, the hooks 12 disposed about the outer circumference of the barrel 11 are inserted into the retaining hook receiving apertures 30 of the rods 32 of the foam darts 36. This configuration stores potential energy that propels the dart when the dart is fired.

A catch 31, shown in FIGS. 5, and 5A-5D, is connected at a mid-point of each of inner and outer elastic bands 14' and 15' (FIG. 6) is connected to a catch 31. Catch 31 could be affixed to the midpoint of a single band, but this configuration is presently not preferred. When inner and outer elastic bands 14' and 15' are used, they are received through holes 31*a* and 31*b*, respectively, on the catch 31. The catch 31 has a hook 33 that is designed to engage a slot 35*b* (FIG. 6) disposed in a rod 32*a* of the foam dart 36*a*. The catch 31 has a narrow edge 31*c* that is designed to slide along the length of the barrel 11 when the dart 36 is being launched. Alternatively, a catch 31', shown in FIGS. 5A and 5B, may be utilized. Catch 31' includes holes 31*a*' and 31*b*', a hook 33' and an arcuate barrel engagement portion 31*d* that has a convex shape adapted to conform and slidingly engage with the outer circumference of barrel 11, thus facilitating steady and consistent launching of foam dart 36. FIGS. 5C and 5D are related to a catch 31", which will be disclosed in detail below.

Figure 6:
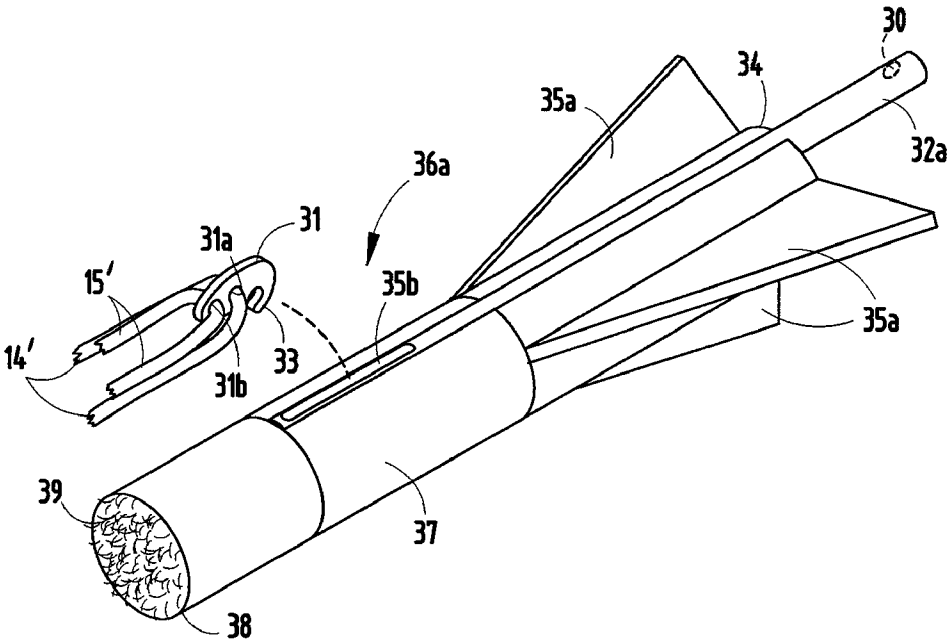
FIG. 6 is an enlarged perspective view of a foam dart prior to engagement with a catch.
Figure 7:
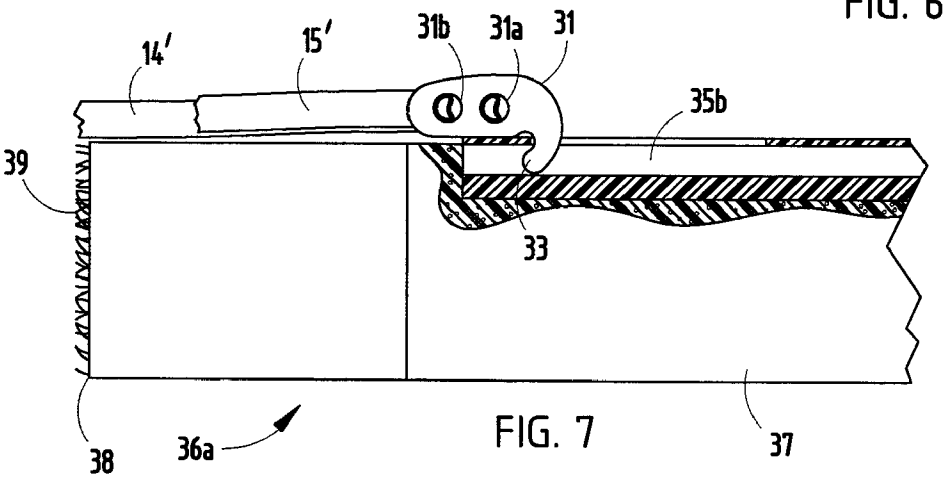
FIG. 7 is an enlarged partial cross-sectional side elevational view of a catch engaging a foam dart.
Figure 8:
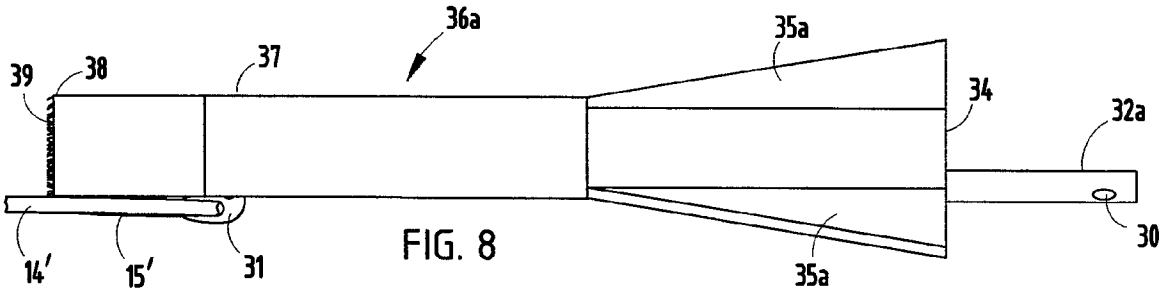
FIG. 8 is an enlarged side elevational view of another embodiment of a foam dart.
Figure 9:
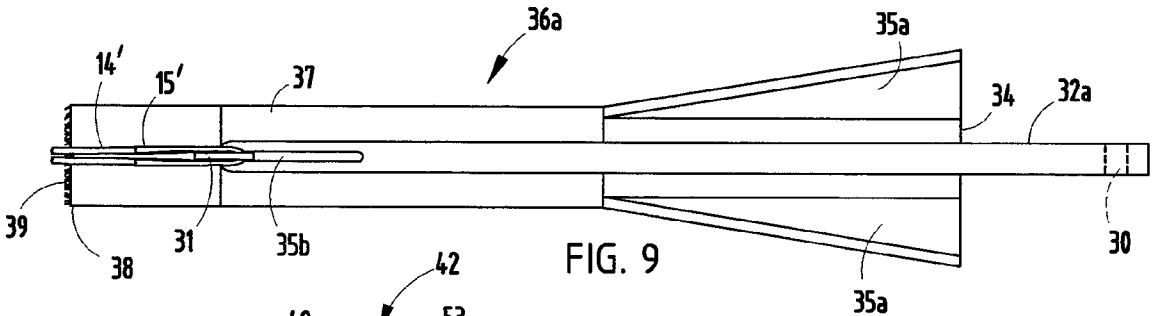
FIG. 9 is bottom elevational view of the foam dart of FIG. 8.

FIGS. 6-9 illustrate an alternative embodiment including a dart 36*a* for use in the foam dart gun 10. In this alternative embodiment, the rod 32*a* has an outer circumference that is tangential with the outer circumference of the foam dart 36*a*. The rod 32*a* is typically engaged along a portion of the perimeter of the dart 36*a* as shown in FIG. 6. The rod 32*a* may be glued or otherwise affixed to the body of the dart 36*a*. Also, there may be a channel in the foam dart 36*a* for receiving the rod 32*a*. Additionally, an elastomeric girdle, typically a plastic girdle 37, which is typically constructed of a spring-like mesh plastic material as shown, may be used to frictionally engage and thereby secure a portion of the rod 32*a* to the foam dart 36*a* to prevent the rod 32*a* from coming separated from the foam dart 36*a*. The plastic girdle 37 is designed to tightly squeeze around the outer circumference of the dart 36*a*, thus minimizing the likelihood that the rod 32*a* will detach from the dart 36*a*. Generally, the girdle 37 is of a slightly smaller diameter than the diameter of the foam dart 36*a* to facilitate frictional engagement of the rod 32*a* and foam dart 36*a*. In such a case, the foam dart 36*a* typically is depressed to temporarily lower the diameter of the foam dart 36*a* to allow the girdle 37 to be placed over the dart 36*a*.

Figure 10:
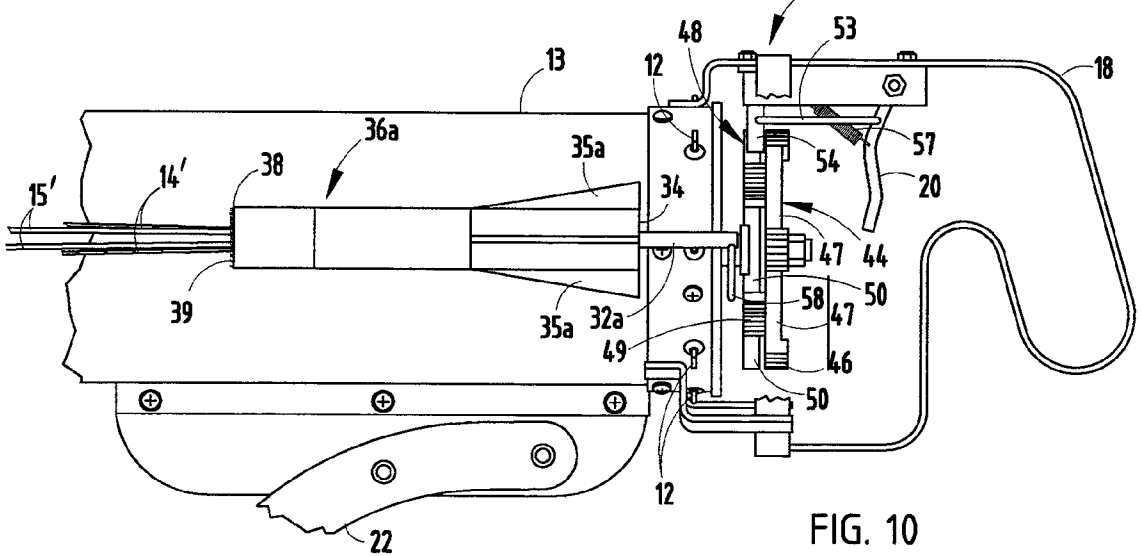
FIG. 10 is an enlarged partial side elevational view of the back end of the foam dart gun loaded with a foam dart.
Figure 12A:
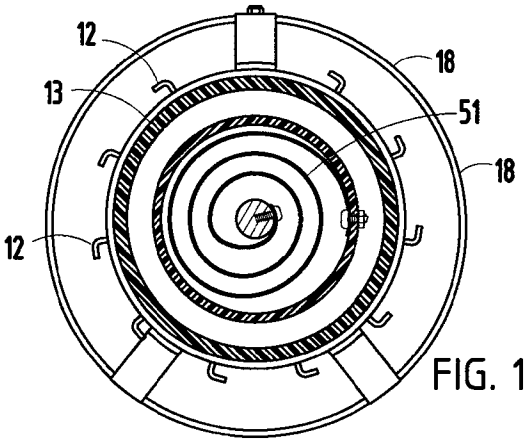
FIG. 12*a* is a rear elevational cross-sectional view of the foam dart gun taken at line XIIA-XIIA of FIG. 12.
Figure 12:
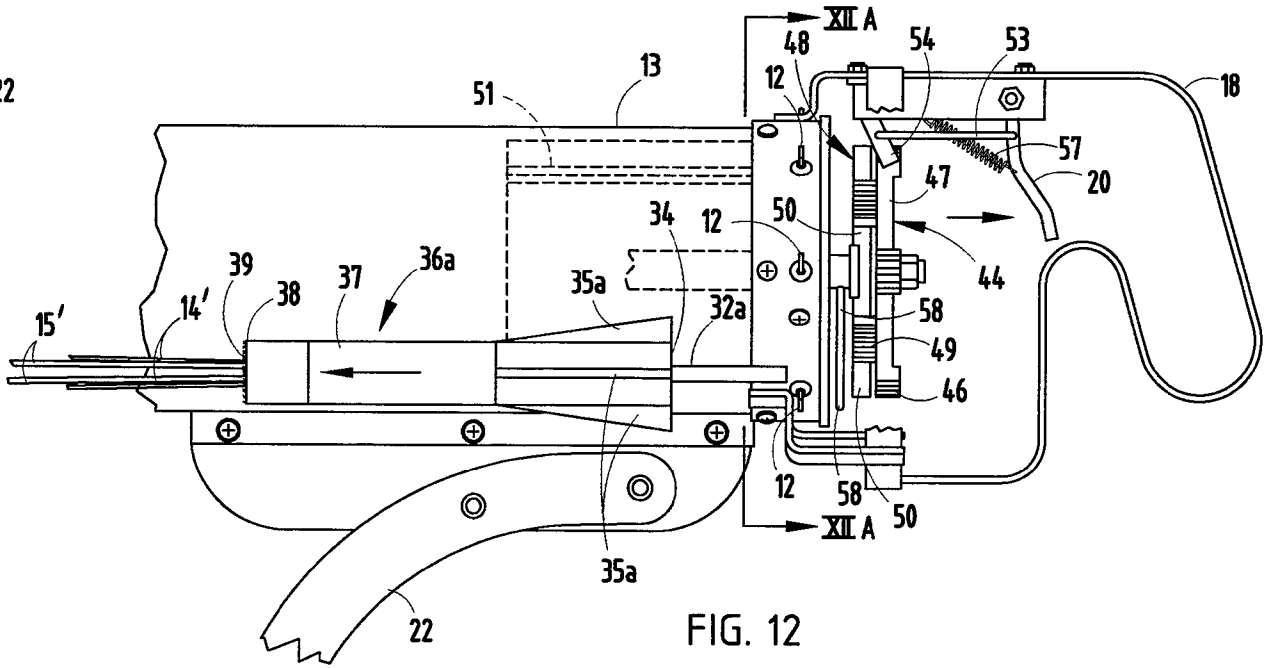
FIG. 12 is an enlarged partial side elevational view of the back end of the foam dart gun of FIG. 1 with the trigger depressed.
Figure 11:
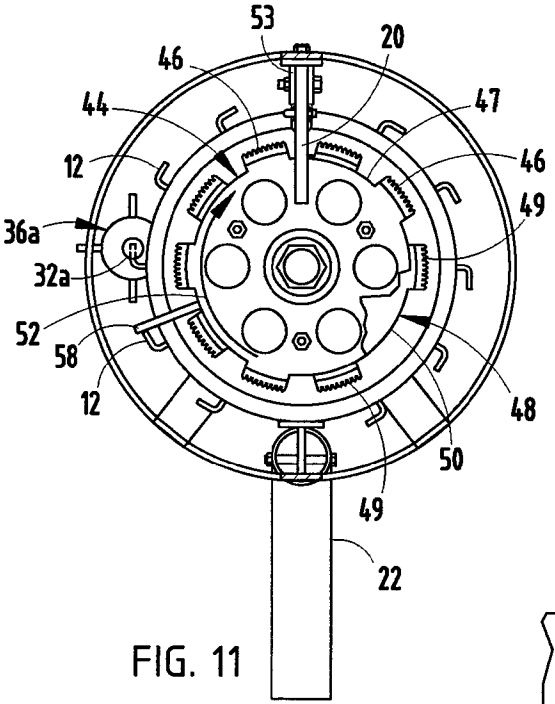
FIG. 11 is a rear elevational view of the foam dart gun of FIG. 1.

FIGS. 10-12 illustrate the trigger 20 and its engagement to a firing apparatus 42. A first circular rotary gear 44 has a plurality of knobs 46 separated by a plurality of openings 47. A second circular rotary gear 48 is engaged to the first circular rotary gear 44 and has a plurality of knobs 49 separated by a plurality of openings 50. The first circular rotary gear 44 is typically connected with the second circular rotary gear 48 such that the knobs 46 of the first circular rotary gear 44 are typically at least substantially aligned with the openings 50 of the second circular rotary gear 48 and, similarly, the knobs 49 of the second circular rotary gear 48 are typically at least substantially aligned with openings 47 of the first circular rotary gear 44. The first and second circular rotary gears 44, 48 are spring-biased by an internal torsion spring 51 (FIG. 12A) to rotate in the direction of arrow 52. The trigger 20 is spring-biased to a forward position and is attached by a crossbar 53 to a trigger bar 54. The trigger 20 pivots about a trigger pivot axis and the trigger bar 54 pivots about a bar pivot axis. Depressing the trigger 20 actuates the trigger bar 54 into a rearward position.

As shown in FIGS. 10 and 12, the trigger bar 54 interferes with rotation of the second circular rotary gear 48 when the trigger 20 is in the forward rest position. When the trigger 20 is depressed, the trigger bar 54 is moved by the crossbar 53 attached to the trigger 20 into the rearward position and accordingly, slides into the opening 47 on the first circular rotary gear 44 and out of interference with one of the knobs 49 on the second circular rotary gear 48. In this position, the trigger bar 54 interferes with one of the knobs 46 on the first circular rotary gear 44 thereby preventing further rotation of the first and second circular gears 44, 48. When the trigger 20 is released, the spring-biased tension acting on the trigger 20 by spring 57 pulls the trigger 20 into the forward position and the crossbar 53 attached to the trigger 20 forces the trigger bar 54 forward and out of interference with one of the knobs 46 on the first circular rotary gear 44 allowing the first and second circular rotary gears 44, 48 to rotate. Subsequently, the trigger bar 54 is again in an interfering position with one of the knobs 46 on the second circular rotary gear 48 thereby preventing further rotation of the first and second rotary gears 44, 48.

As seen in FIGS. 11 and 12, a displacement lever 58 is secured to the first and second rotary gears 44, 48. The displacement lever 58 rotates with the first and second rotary gears 44, 48 each time the trigger 20 is actuated either by pressing or releasing the trigger 20. As the displacement lever 58 rotates, it strikes the rod 32 of the dart 36*a* forcing the retaining hook receiving aperture 30 in the rod 32 of the foam dart 36*a* off of the hook 12. The knobs 46, 49 and openings 47, 50 of the first and second circular rotary gears 44, 48 are of a sufficient size to allow rotation of the displacement lever 58 a distance that is typically at least about equal to the distance between the hooks 12 on the outer circumference of the barrel 11. Therefore, when the trigger 20 is depressed or released, the displacement lever 58 rotates past a single hook 12. When one of the hooks 12 is fully removed from the retaining hook receiving aperture 30 in the rod 32 of the foam dart 36, the foam dart 36 is propelled forward utilizing kinetic energy from the inner and outer elastic bands 14 and 15 that is acting on the catch 40 of the foam dart 36.

Figure 13:
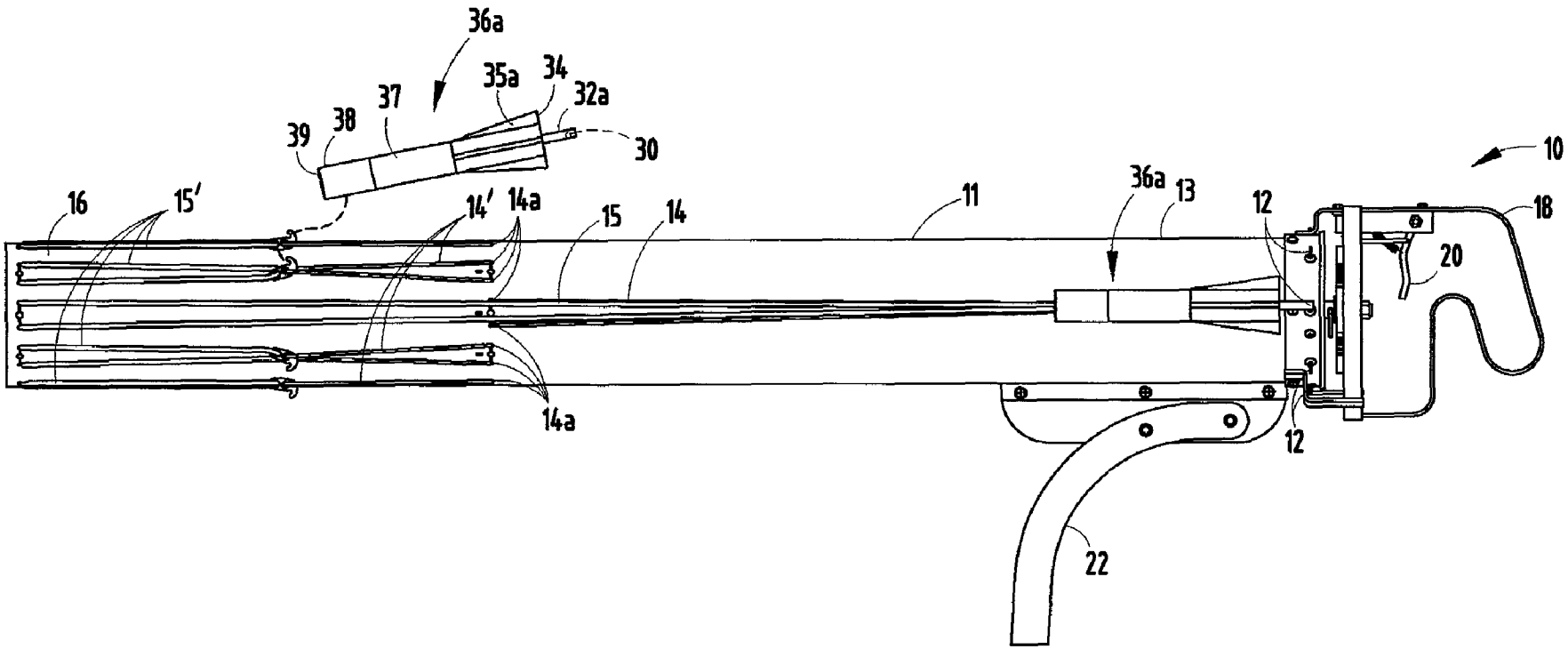
FIG. 13 is a side elevational view of the foam dart gun of FIG. 1 loaded with a foam dart.

In use, a person releasably secures the catch 40 of the foam dart 36 to the mid-point of adjoining inner and outer elastic bands 14, 15. The person stretches the inner and outer elastic bands 14, 15 thereby adding energy to the inner and outer elastic bands 14, 15. The person stretches the inner and outer elastic bands 14, 15 a distance to allow insertion of the hook 12 that is at least substantially longitudinally aligned with a specific inner and outer elastic band 14, 15. The hook 12 is inserted into retaining hook receiving aperture 30 in rod 32*a* of the foam dart 36*a*, as shown in FIG. 13. Numerous foam darts 36*a* may be inserted in this manner. When a predetermined number of darts 36*a* have been loaded, the gun 10 is ready for firing. The person may fire the gun 10 by either depressing the trigger 20 or by releasing the trigger 20. Each time the trigger 20 is depressed or released, the displacement lever 58 rotates with the first and second circular rotary gears 44, 48, and actuates rod 32*a* such that a single hook 12 no longer retains the dart 36*a* thereby launching the dart 36*a* toward a target. As discussed above, the potential energy stored in the inner and outer elastic bands 14, 15 is converted to kinetic energy, which propels the dart 36*a* forward. It is to be understood that a foam dart 36 could be launched in a similar manner as that described above with respect to the foam dart 36*a*.

Figure 15:
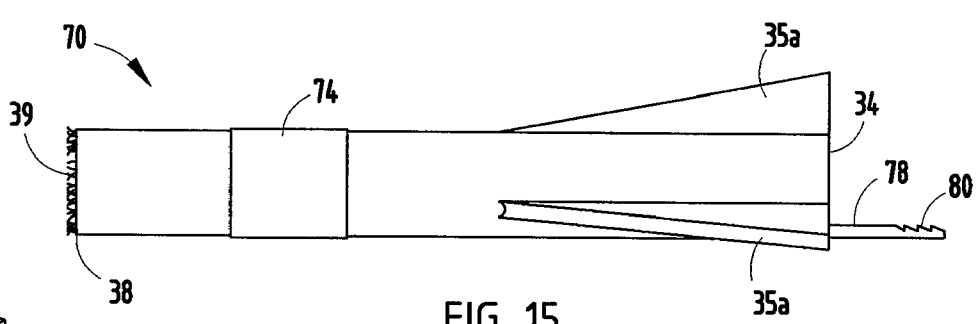
FIG. 15 is an enlarged side elevational view of the foam dart of FIG. 14.
Figure 16:
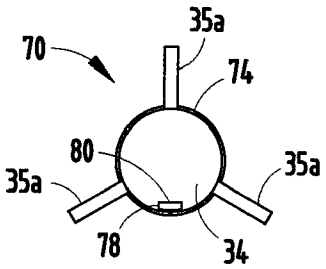
FIG. 16 is an enlarged rear elevational view of the foam dart of FIG. 15.
Figure 14:
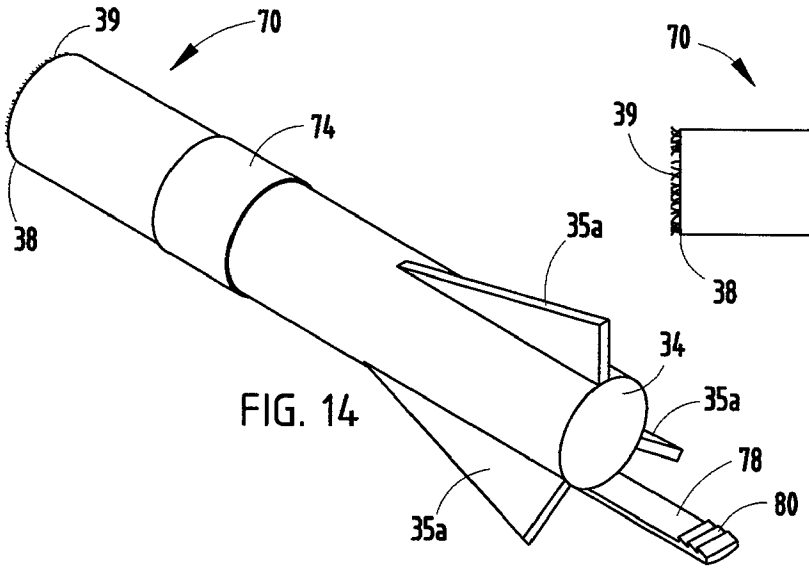
FIG. 14 is an enlarged perspective view of another embodiment of a foam dart of the present invention.

Another embodiment of a foam dart is shown in FIGS. 14-16. A foam dart 70 includes several fins 35*a* and a front end 38 having one of a hook and loop fastening system 39 such as VELCRO® which, in a game-playing situation, would attach readily to an opponent's vest that utilizes a complementary component of the hook and loop fastening system 39. The foam dart 70 has a similar construction to foam darts 36 and 36*a*, and it is to be understood that those components of the foam darts 36, 36*a*, and 70 the have the same reference numerals are generally the same. A girdle 74 is connected to an outer circumference of the foam dart 70 between the front end 38 and rear end 34 of the foam dart 70. The girdle 74 is also connected to the front end of a jam stick 78. The girdle 74 or the jam stick 78 or both include an opening or indentation into which the elastic band assembly clip hook 33 (FIGS. 5, 5A and 5B) is inserted. The jam stick 78 extends parallel with and adjacent to the foam dart 70 and protrudes beyond the rear end of the foam dart 70. A distal end of the jam stick 78 includes a plurality of laterally extending grooves 80 or slots or possibly catch material adapted to engage teeth 110 or catch material on the bottom side 112 of a jam cleat release lever 86 as discussed in further detail below. The catch material is a material or substance having a high coefficient of friction, such as rubber. The catch material may be used alone or in conjunction with the laterally extending grooves 80.

Figure 17:
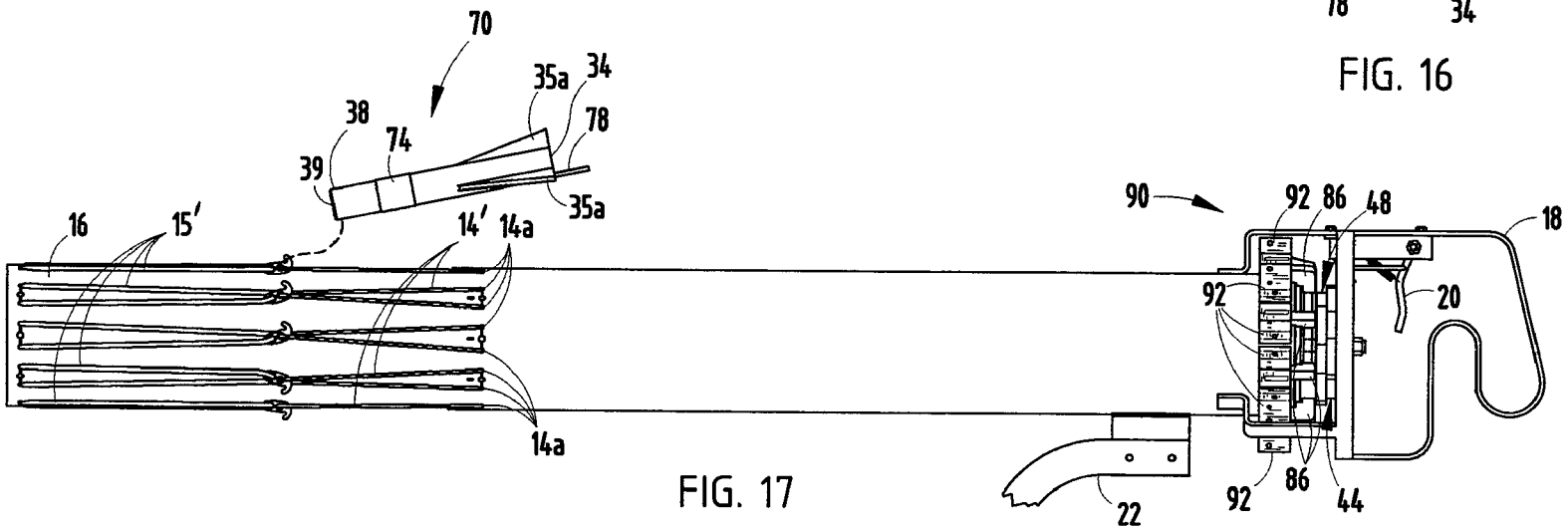
FIG. 17 is a side elevational view of another embodiment of the foam dart gun of the present invention.

FIG. 17 illustrates another embodiment for a foam dart gun. The foam dart gun 90 has a similar construction to gun 10 and it is to be understood that those components of the first and second embodiments that have the same reference numerals are generally the same. The first end of gun 90 includes an alternative design incorporating a different manner of securing and releasing darts 70 from the gun 90. More specifically, gun 90 is adapted to fire foam darts 70 by way of a plurality of jam cleat release levers 86 that are mounted inside a plurality of corresponding channel-shaped mounting brackets 92.

Figures 18, 19:
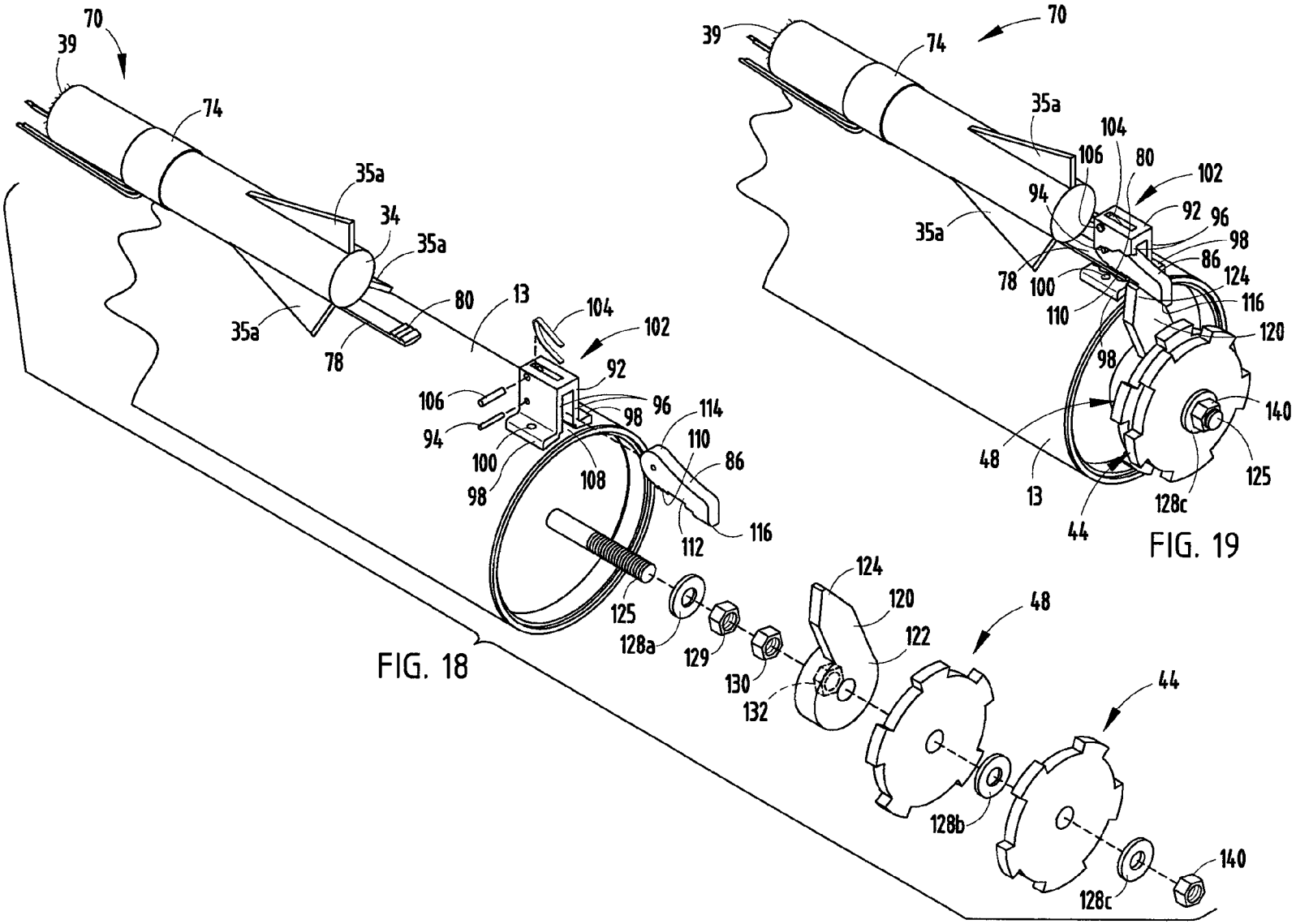
FIG. 18 is a partial exploded perspective view of the rear of the foam dart gun of FIG. 17.
FIG. 19 is a partial perspective view of the rear of the foam dart gun of FIG. 17.

FIGS. 18 and 19 illustrate the gun 90 with the handle 18 and trigger 20 assemblies removed. The channel-shaped mounting brackets 92 house the jam cleat release lever 86 and include a pivot pin 94 to allow rotation of the jam cleat release lever 86. Although only one channel-shaped mounting bracket and one jam cleat release lever are shown in FIGS. 18 and 19 for ease of illustration and explanation, it should be understood that multiple channel-shaped mounting brackets 92 and jam cleat release levers 86 are preferably located around the circumference of the barrel 11. The channel-shaped mounting bracket 92 includes two legs 96 with outwardly extending flanges 98 having mounting apertures 100 for the purpose of mounting the bracket 92 to the outer circumference of the gun barrel 11 by mechanical fasteners. A spring assembly 102 that includes a spring 104 and spring pin 106 inside the mounting bracket 92 acts to bias the bottom of the jam cleat release lever 86 into contact with the outer circumference of the barrel 11. The outwardly extending flanges 98 of the mounting bracket legs 96 are arcuately shaped to correspond with the arcuate shape of the outer circumference of the gun barrel 11. The mounting bracket 92 also includes an enlarged opening 108. The enlarged opening 108 allows a user to mount the jam stick 78 of the foam dart 70 into the jam cleat release lever 86 as will be discussed in further detail below.

Referring again to FIG. 18, the jam cleat release lever 86 has a teardrop shape with teeth 110 on a bottom side 112 of the jam cleat release lever 86 as well as a rounded top surface 114. Alternatively, the bottom side 112 of the jam cleat release lever 86 may include a catch material having a high coefficient of friction. The catch material may be used alone or in conjunction with the teeth 110 on the bottom side 112 of the jam cleat release lever 86. The jagged teeth 110 are designed to engage the lateral grooves 80 of the jam stick 78 of the foam dart 70. A rearward end of the jam cleat release lever 86 has a rounded contact surface 116 that is adapted for engagement with an engagement portion 120 of a rotating trigger cam 122. The engagement portion 120 has an inclined contact surface 124 which is adapted to engage the rounded contact surface 116 of the jam cleat release lever 86. The trigger cam 122 is under constant torsional force that is provided by a torsion spring located inside the barrel 11. The trigger cam 122 of gun 90 rotates in a manner similar to the displacement lever 58 of gun 10 when the trigger 20 is depressed and released to move trigger bar 54 into and out of engagement with knobs 46, 49 on the first and second circular rotary gears 44, 48, as described in detail above with respect to FIGS. 10 and 12.

Figure 24:
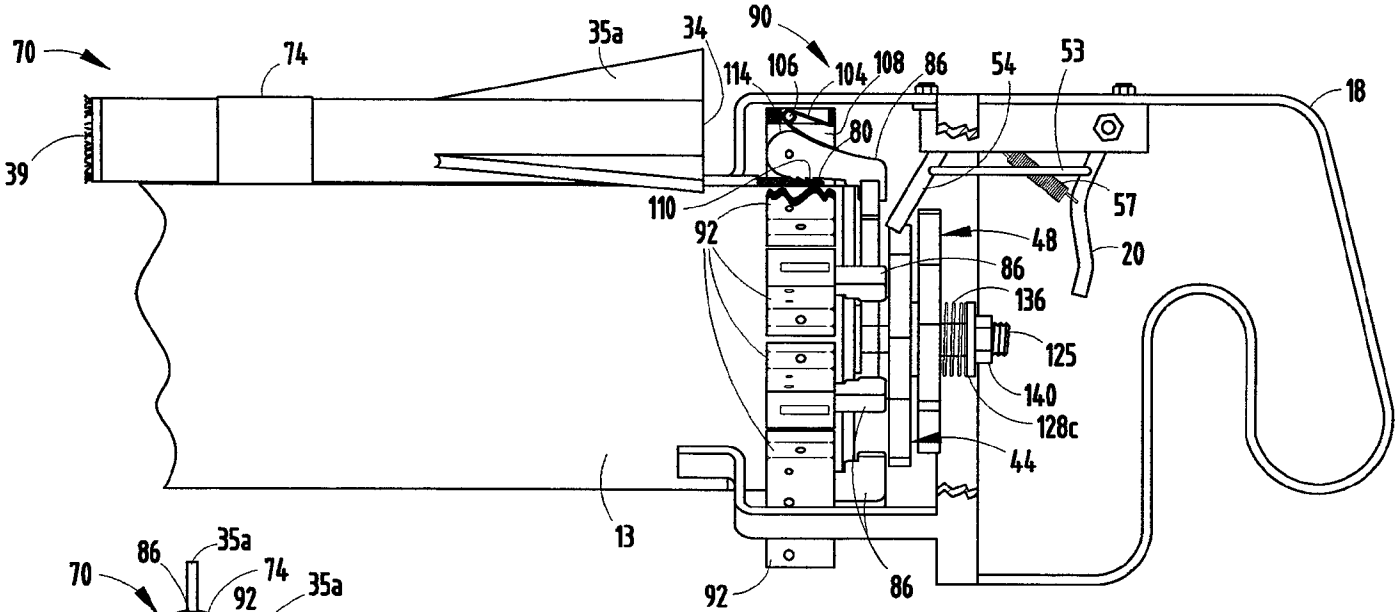
FIG. 24 is an enlarged partial side elevational view of the foam dart gun of FIG. 17 with a foam dart loaded.
Figure 23:
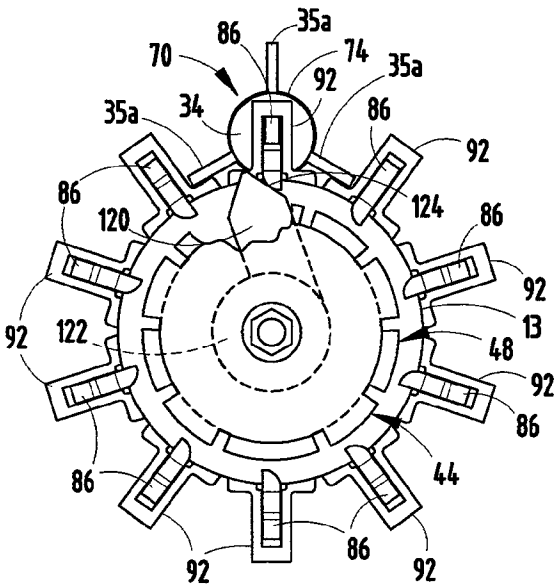
FIG. 23 is an enlarged rear elevational view of the foam dart gun of FIG. 17 with a foam dart loaded.
Figure 26:
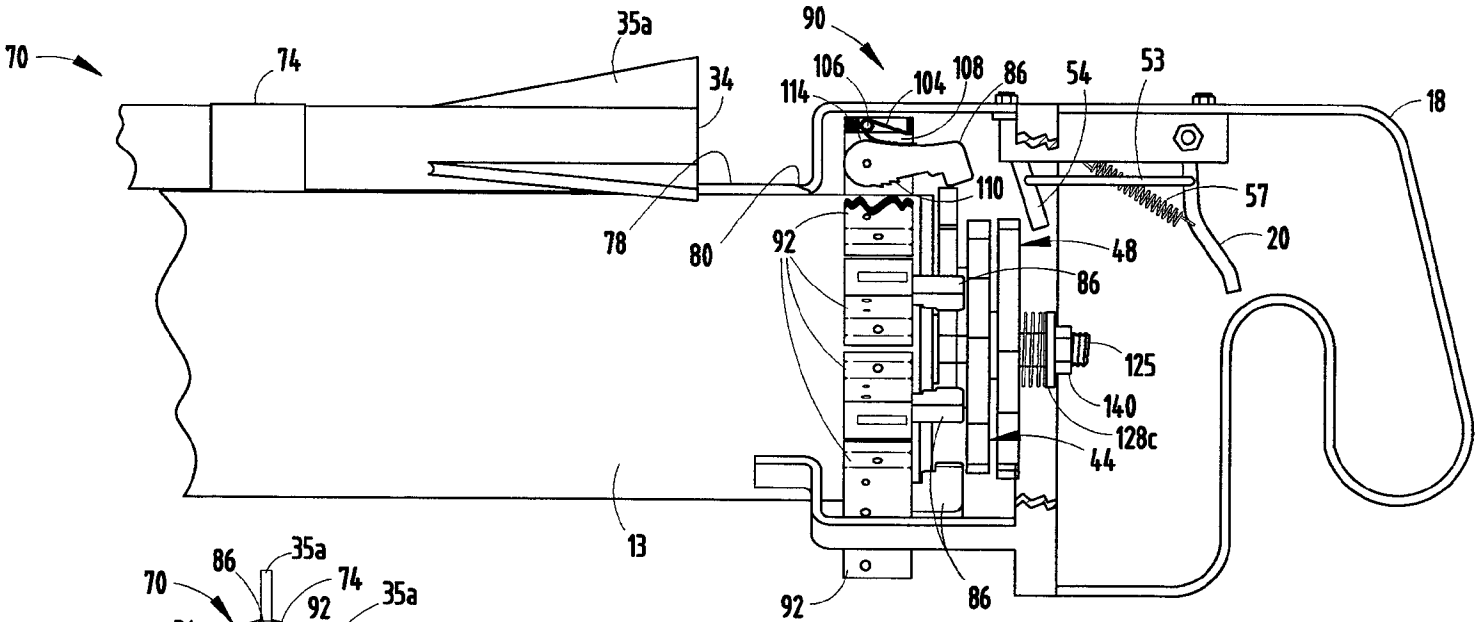
FIG. 26 is an enlarged side elevational view of the foam dart gun of FIG. 17 launching a foam dart.
Figure 25:
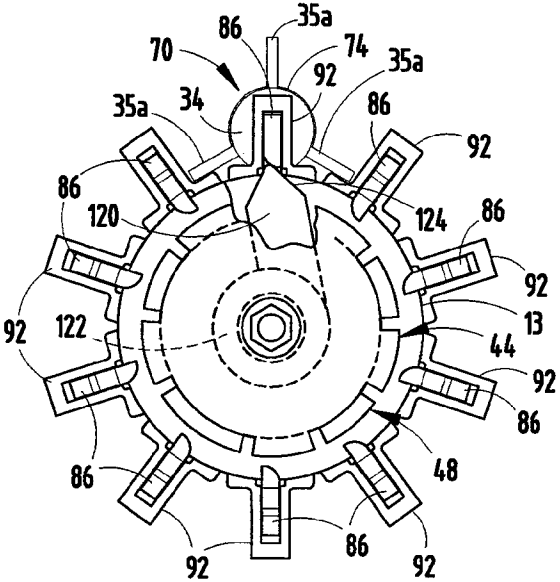
FIG. 25 is an enlarged rear elevational view of the foam dart gun of FIG. 17 launching a foam dart.

Referring to FIGS. 18 and 19, the threaded rod 125 extends outwardly from the back of the gun 90. The torsion spring 51 (FIG. 12*a*) is secured on one end to the inside of the barrel 11 and on the other side to the threaded rod 125. A spreader 128*a*, such as a washer, is inserted over the rod 125 and first and second mechanical fasteners 129, 130, such as nuts, are secured on the threaded rod 125. A rotatable trigger cam 122 is included and has a receiving slot 132 shaped to closely receive at least one of the mechanical fasteners 129, 130. The threaded rod 125 extends through the first rotary gear 44, a second spreader 128*b* (such as washer), and a second circular rotary gear 48. The trigger cam 122, first rotary gear 44, second spreader 128*b*, and second rotary gear 48, are held in place by a third spreader 128*c* (such as a washer) and third mechanical fastener 140, such as a nut. As the trigger 20 of the gun 90 is depressed or released, the trigger cam 122, which is connected to the first and second gears 44, 48, rotates by way of the torsional spring force applied by the torsion spring 51 (FIG. 12A). As the trigger cam 122 rotates, the engagement portion 120 on the trigger cam 122 rotates into contact with the rounded contact surface 116 of the jam cleat release lever 86 (FIGS. 23 and 24). As the engagement portion 120 strikes the rounded contact surface 116 of the jam cleat release lever 86, the rounded contact surface 116 is lifted, raising the teeth 110 or catch material or both (FIGS. 25 and 26). The force related to the rotation of the trigger cam 122 is great enough to overcome the opposing contact force supplied by the spring assembly 102 and by the elastic bands 14', 15' which pull the jam cleat release lever 86 into frictional engagement with the jam stick 78 of the foam dart 70. As the jam cleat release lever 86 is raised by the rotating trigger cam 122, the teeth 110 and/or catch material of the jam cleat release lever 86 separate from the grooves 80 and/or catch material of the jam stick 78 and the dart 70 is released and launched.

Figure 27:
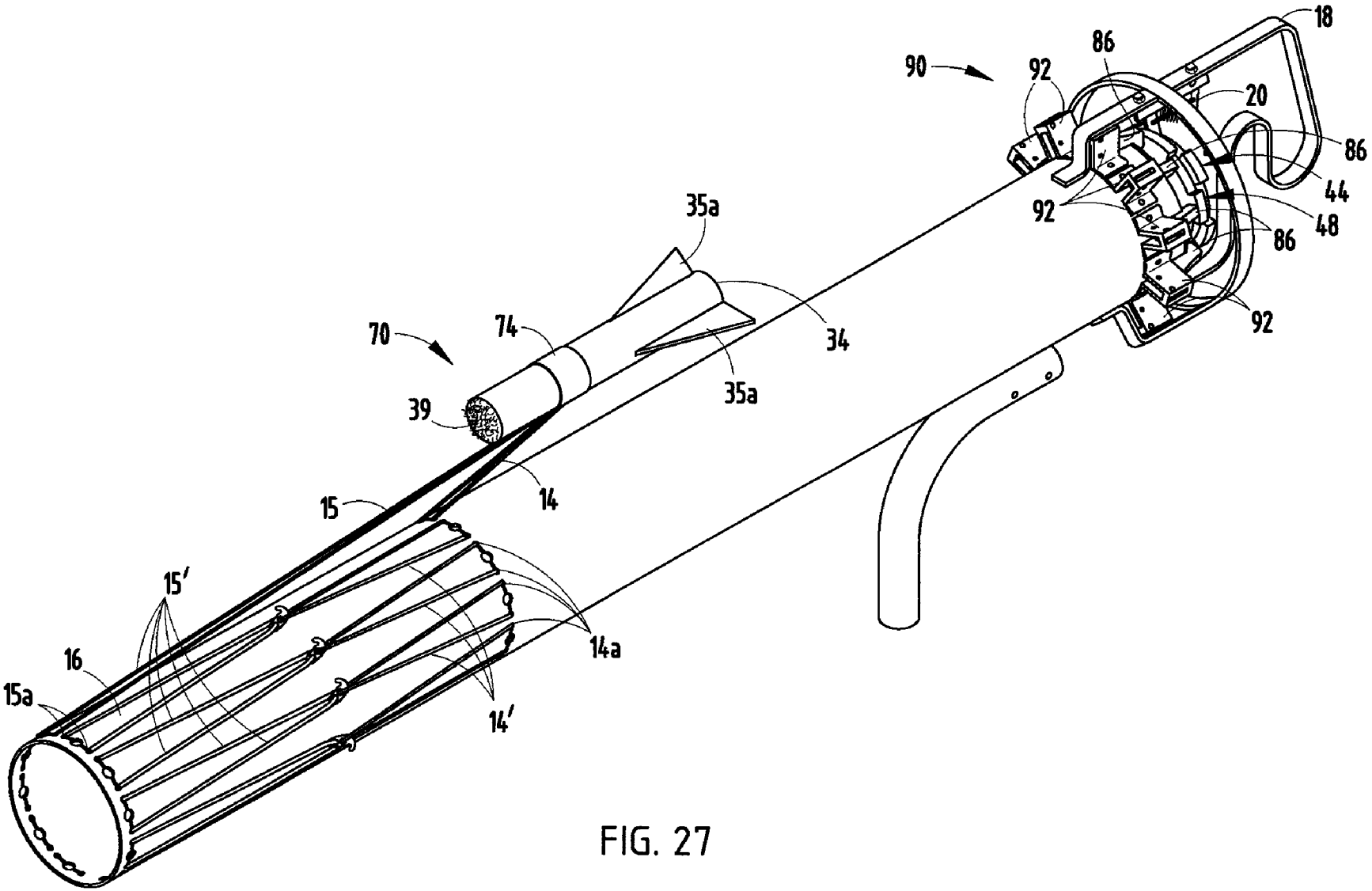
FIG. 27 is a perspective view of the foam dart gun of FIG. 17 launching a foam dart.

Referring to FIG. 27, to reload, a user engages the slot 35*b* of the dart 70 with the catch 31 or 31' secured to the midpoints of the inner and outer elastic bands 14 and 15. When the dart 70 is securely engaged with the catch 31 or 31', the dart 70 is pulled back toward the jam cleat release lever 86. The user then inserts the jam stick 78 of the foam dart 70 into the enlarged opening of the jam cleat mounting bracket 92 until the rear end of the dart 70 touches the mounting bracket 92. As the user lets go, the spring force acting on the jam cleat release lever 86 rotates the jam cleat release lever 86 downward into frictional engagement with the jam stick 78. The laterally extending grooves 80 of the jam stick 78 interface with the teeth 110 of the jam cleat release lever 86 to hold the foam dart 70 in place. Note that the foam dart 70 should be secured in a complimentary mounting bracket 92 that lines up with the inner and outer elastic bands 14 and 15 to which the foam dart 70 is attached.

Figures 20, 21, 22:
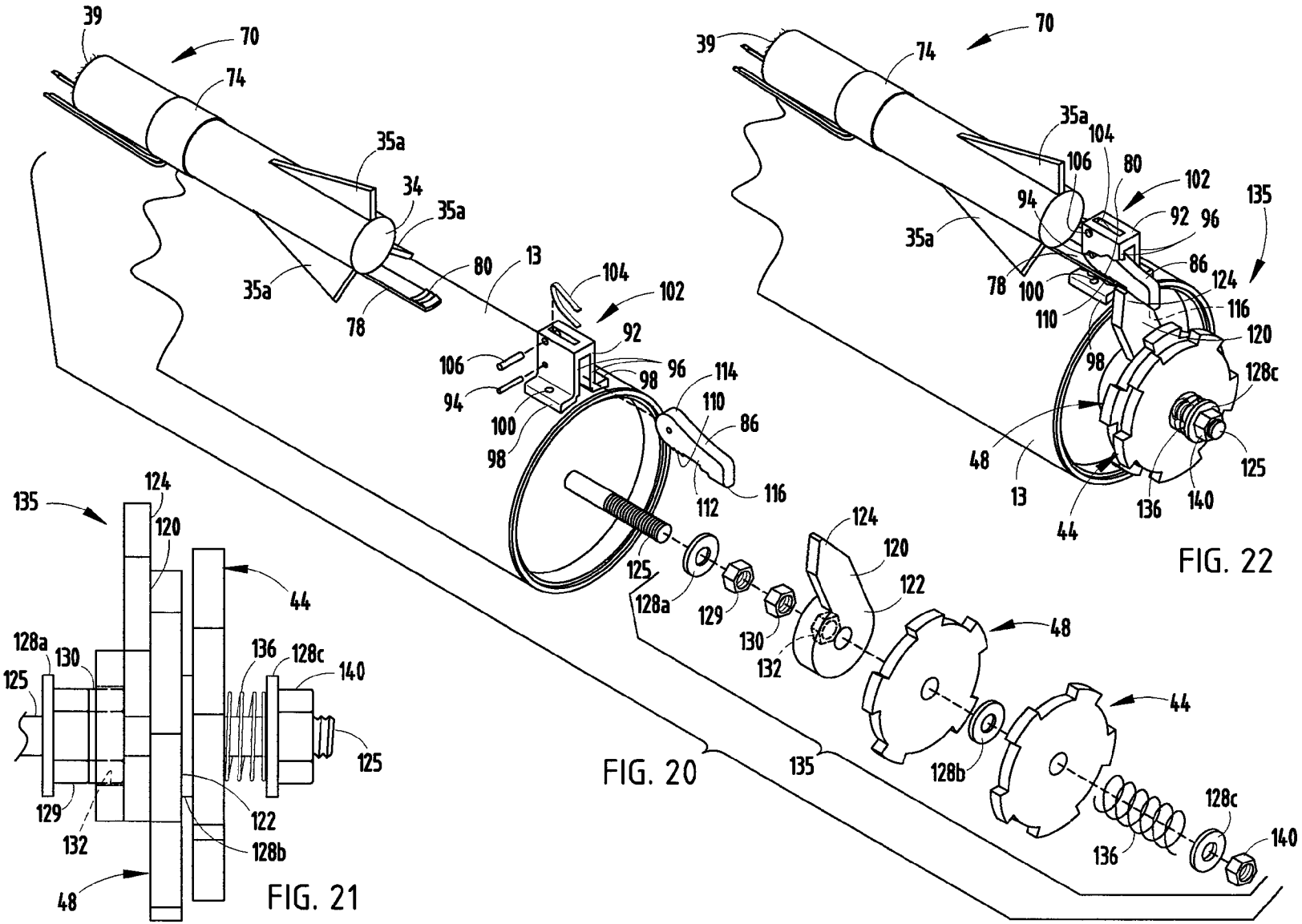
FIG. 20 is a partial exploded perspective view of another embodiment of the rear of a foam dart gun including a quick release trigger cam system.
FIG. 21 is a side elevational view of a quick release trigger cam system.
FIG. 22 is a partial perspective view of the rear of a foam dart gun including a quick release trigger cam system.

FIGS. 20-22 illustrate a quick release trigger cam system 135. The quick release trigger cam system 135 includes a threaded bolt that extends into the barrel of the gun and is attached to the torsion spring inside the barrel. The torsion spring 51 is secured on one end to the inside of the barrel 11 and on the other side to the threaded rod 125. The threaded rod 125 extends outwardly from the back of the gun 90. A spreader 128, such as a washer, is inserted over the rod 125 and first and second mechanical fasteners 129, 130, such as nuts, are secured on the threaded rod 125. A rotatable trigger cam 122 is included and has a receiving slot 132 shaped to closely receive at least one of the mechanical fasteners 129, 130. The threaded rod 125 extends through the first rotary gear 44, a second spreader 128*b*, second circular rotary gear 48, and a compression spring 136. The trigger cam 122, first rotary gear 44, second spreader 128*b*, second rotary gear 48, and the compression spring 136 are held in place by a third spreader 128*c* and third mechanical fastener 140. To increase the torque acting on the trigger cam 122 by the torsion spring 51, the quick release trigger cam system 135 must be wound against the torsional force of the torsion spring 51. The quick release trigger cam system 135 design allows the user to pull the rotatable trigger cam 122 away from the trigger bar 54 against the force of the compression spring 136 and easily rewind the trigger cam 122 without having to hold the trigger bar 54 out of the way. This lessens the time it takes to restore torque in the torsion spring 51 (FIG. 12A).

Figures 28, 29, 30, 31:
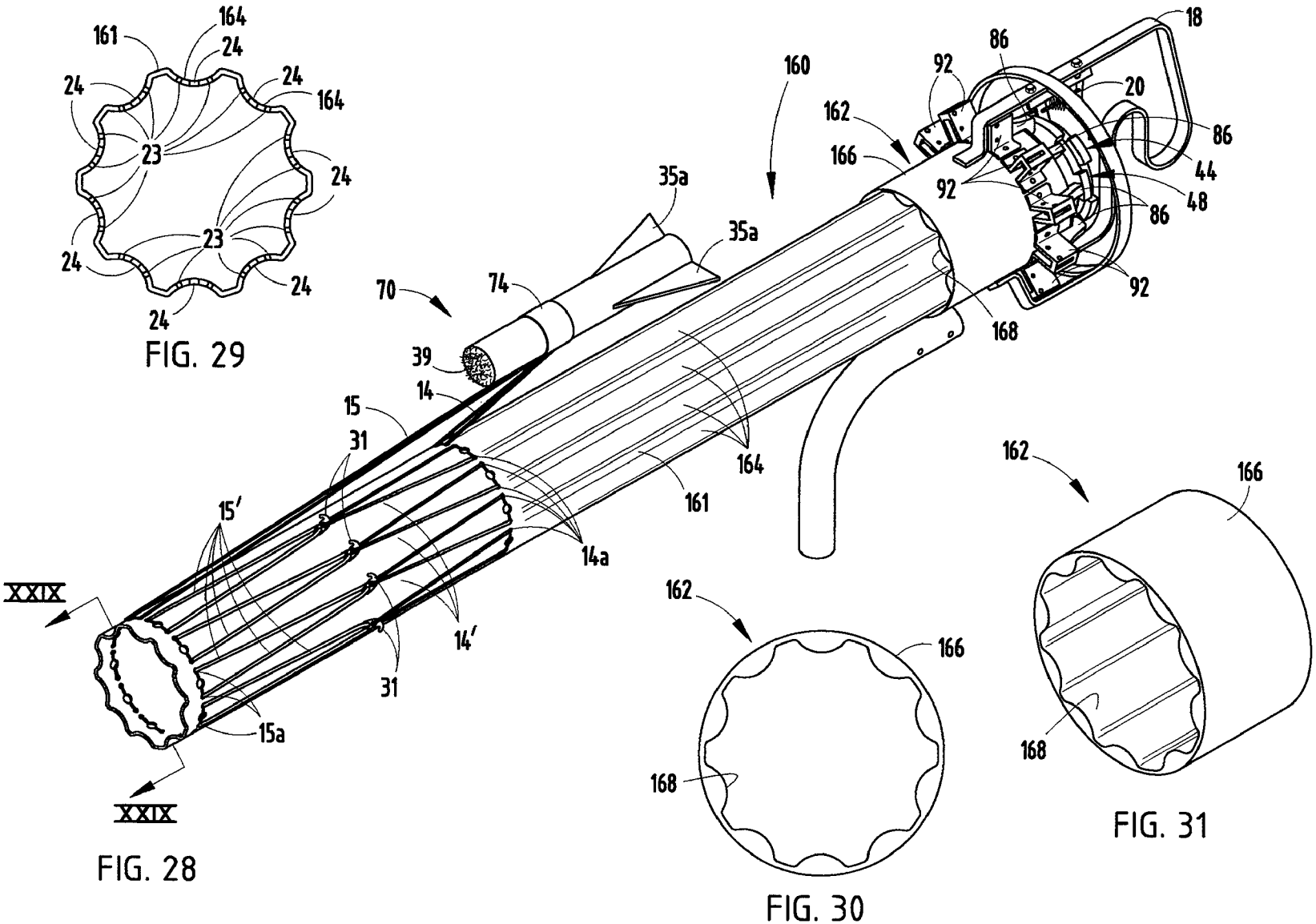
FIG. 28 is a perspective view of another embodiment of a foam dart gun launching a foam dart.
FIG. 29 is an enlarged elevational cross-sectional view of the foam dart gun of FIG. 28 taken at line XXIX-XXIX.
FIG. 30 is an enlarged front elevational view of an adapter sleeve of the present invention.
FIG. 31 is an enlarged perspective view of the adapter sleeve of FIG. 30.

An alternative embodiment of a gun is shown in FIG. 29. A gun 160 has a corrugated barrel 161 with an adapter sleeve 162. The corrugated barrel 161 includes a corrugated circumference having multiple elongate channel sections 164. The width of each channel section 164 is equal to or larger than the foam dart 70 and provides a path for the dart 70 to follow when being propelled, or launched, by the first and second elastic bands 14', 15'. As shown in FIG. 28, near the distal end of the barrel 161, the elastomeric member receiving aperture 24 is approximately centrally located in each corrugation, or channel, with outwardly extending grooves 25 projecting outwardly therefrom. The inner and outer elastic band ends 14*a*, 15*a* are pinched and slid through the outwardly extending grooves 25 until the bulbous end 26 is retained in the retaining apertures 28 on the interior surface of the barrel 11. With this design, the corrugations assist in directing the foam dart down the longitudinal extent of the channel sections along the barrel 11.

Referring to FIGS. 30 and 31, the adapter sleeve 162 is located at the barrel 161 and includes a circular outside perimeter 166 and a corrugated interior perimeter 168. The corrugated interior perimeter 168 of the adapter sleeve 162 is complementary with the outside corrugated perimeter 166 of the barrel 161. The adapter sleeve 162 provides a surface to which the mounting brackets 92 or retaining hooks 12 of the gun 90 or gun 10, respectively, may be attached. The handle 18 is also attached to the adapter sleeve 162. The adapter sleeve 162 is secured to the barrel 161 by mechanical fasteners. It is contemplated that the adapter sleeve 162 can be used to provide a rounded surface onto which other parts could be mounted.

FIGS. 5C and 5D illustrate yet another embodiment for a catch for use with barrel 161. A catch 31" includes holes 31*a*" and 31*b*", a hook 33" and an arcuate barrel engagement portion 31*e* that has a concave shape adapted to conform and slidingly engage with one of the channel sections 164 of barrel 161. This design assists in projecting the foam dart 70 down the channel section 164.

In the foregoing description, it will be readily appreciated by those skilled in the art that modifications may be made to the invention without departing from the concepts disclosed herein. Such modifications are to be considered as included in the following claims, unless these claims by their language, expressly state otherwise.

The invention claimed is:

1. A dart gun comprising:

a cylinder;

an inner elastic band connected with a middle portion of the cylinder and an outer elastic band connected with a distal end of the cylinder, the inner elastic band and the outer elastic band being operably coupled at a junction;

a trigger connected with the cylinder and operably coupled to a trigger bar; and a projectile detachably connected to the cylinder and to the junction of the inner and outer elastic bands, wherein the trigger bar disconnects the projectile from the cylinder upon actuation of the trigger such that the inner and outer elastic bands propel the projectile forward.

2. The dart gun of claim 1, further comprising:

a catch connected to the inner and outer elastic bands proximate the point where the outer elastic band is operably coupled with the inner elastic band.

3. The dart gun of claim 2, wherein:

the projectile is a dart having a slot designed to receive the catch.

4. The dart gun of claim 3, wherein the dart includes a rod that projects from a rear end of the dart and includes a hook receiving aperture adapted to engage one of a plurality of hooks disposed at the first end of the cylinder.

* * * * *